US005193809A

United States Patent [19]

Hrsel et al.

[11] Patent Number: 5,193,809

[45] Date of Patent: Mar. 16, 1993

[54] THREE-DIMENSIONAL PUZZLE

[76] Inventors: Karel Hrsel, Nedvedovo Namesti 5, 147 00 Praha 4; Vojtech Kopksy, Bajkalska 28, 100 00 Praha, both of Czechoslovakia

[21] Appl. No.: 788,751

[22] Filed: Nov. 7, 1991

[30] Foreign Application Priority Data

Nov. 8, 1990 [CS] Czechoslovakia ..... 5504-90

[51] Int. Cl.[5] ..... A63F 9/08

[52] U.S. Cl. ..... 273/153 S

[58] Field of Search ..... 273/153 S, 153 R; 446/487, 489

[56] References Cited

U.S. PATENT DOCUMENTS

| | | | |
|---|---|---|---|
| 4,421,311 | 12/1983 | Sebesteny | 273/153 S |
| 4,461,480 | 7/1984 | Mitchell | 273/155 |
| 4,474,377 | 10/1984 | Ashley | 273/153 S |
| 4,513,970 | 4/1985 | Opresco et al. | 273/153 S |
| 4,593,908 | 6/1986 | Ibrahim | 273/153 S |
| 4,836,549 | 6/1989 | Flake | 273/153 S |

FOREIGN PATENT DOCUMENTS

| | | | |
|---|---|---|---|
| V15667 | 4/1984 | Czechoslovakia . | |
| V15666 | 7/1984 | Czechoslovakia . | |
| 9014140 | 11/1990 | World Int. Prop. O. | 273/153 S |

*Primary Examiner*—Benjamin Layno
*Assistant Examiner*—Steven B. Wong
*Attorney, Agent, or Firm*—Finnegan, Henderson, Farabow, Garrett & Dunner

[57] ABSTRACT

The three-dimensional prism puzzle includes an internal mechanism including a cylindrical body divided along a vertical axial plane into two identical portions mutually adjustable by rotation about a radially extending connecting pivot fitted centers. The prism has external exterior segments nominally grouped into three horizontally layered assemblies or structures, namely a middle structure and two adjacent peripheral structures. The cylindrical body portions have at their ends radial projections for mounting exterior segments belonging to the peripheral structures, which segments are provided with complementary recesses, and the shape of these exterior segments is defined by four vertical planes traversing the geometrical center of the prism at an angle of 75° with respect to intersecting vertical faces of the prism. The exterior segments of the middle structure are fastened on respective portions of the cylindrical body of the internal mechanism the dividing plane of which includes with a longer opposite face of the exterior segment of the middle structure an angle of 15°. The ratio of the length of the base of the prism to its height equals cos 15°.

11 Claims, 6 Drawing Sheets

THREE-DIMENSIONAL PUZZLE

BACKGROUND OF THE INVENTION

A. Field of the Invention

The present invention relates generally to deformable three-dimensional puzzles and, particularly to three dimensional puzzles having the shape of a regular hexahedral prism.

B. Description of the Prior Art

Most of the three-dimensional puzzles known until now belong to the group of so called Rubic type puzzles the first of which was the Rubic cube which became also the most popular one. The high symmetry of these puzzles which enables their suitable design nevertheless, from the mathematical point of view, contributes to their rather easy solution.

A quite different group of puzzles, taken again from the mathematical point of view, represent puzzles which are capable of changing their symmetry in various configurations. They are also different with respect to their design since their various configurations may be diversified not only by way of the color permutations of segment faces but also through their various shapes and symmetries.

To this new type of puzzles belongs the cube disclosed in the Czechoslovak patent on the industrial design No. 15666. The construction of the internal mechanism and arrangement of the exterior segments of this puzzle allow, however, only those compact shape configurations which are characterized by arrangement of the principal faces of the exterior segments belonging to the middle structure in one plane when these exterior segments engage each other with their entire contact surfaces. As far as the exterior segments are not turned to this position the exterior segments of the puzzle do not occupy a stable position.

In these unstable interim positions the outside functional faces of the exterior segments do not engage each other and on the contrary the non-functional lateral faces of the exterior segments are exposed. Thus, in those interim positions the puzzle does not take up geometrically interesting shapes and does not constitute a stable compact body.

The said three-dimensional body may become stable in shape only in the positions when the outside form of the body is in vertical direction defined by two horizontal planes. The overall visual impression of the puzzle is characterized only by those dominant integral faces of the exterior segments belonging to the outside structures.

SUMMARY OF THE INVENTION

The object of the invention is to overcome disadvantages of the present three-dimensional puzzles and to extend the number of feasible shape configurations of the heretofore described type of the three-dimensional puzzle.

According to the invention this aim is achieved by a three-dimensional puzzle having a shape of a regular hexahedral prism characterized in that the ratio of the length of the base of the prism to the height of the tetrahedron L/H equals cos 15°, and exterior segments of a middle structure are fastened to portions of a cylindrical body of an internal mechanism the parting plane of which stands at an angle of 15° to a longer opposite face of the exterior segment belonging to the middle structure.

The internal mechanism specifically includes a cylindrical body divided along its axial plane into two identical portions. The portions are mutually adjustable by rotation about a radially extending connecting pivot fitted in their centers. The portions have at their ends radial projections enabling the exterior segments which are provided by complementary recesses to be mounted thereon. The shape of the exterior segments belonging to peripheral structures of segments is defined by four vertical planes traversing the geometrical center of the prism at an angle of 75° with respect to faces of the prism.

To secure the uniform outside appearance of the visible surface of the three-dimensional puzzle with every feasible permutation of the exterior segments, it is advantageous if the inside faces of the exterior segments belonging to peripheral structures have the same or similar surface dressing as have the exterior segments of all structures.

Another object of the present invention is to avoid the abrasion of the contacting faces of the exterior segments of the middle structure and/or of the exterior segments of the peripheral structures by providing these contacting faces with bearing steps.

A general advantage of the puzzle of the invention on comparison with the known puzzles is that the internal mechanism and arrangement of the interior segments together with the described ratio of the length of the base to the height of the prism make possible to keep the puzzle in the stable state even in the position where the principal faces of the exterior segments belonging to the middle structures include right angles. Even in this position and state the three-dimensional puzzle takes up the compact outside shape since the outside faces of the exterior segments form the continuous surface.

Due to the new arrangement the invention provides for the substantial enlargement of the number of the shape configurations wherein the additional new configurations are, in respect of the visual impression of the three-dimensional puzzle, mostly more interesting and appealing than are the feasible shape configurations of the known puzzles.

BRIEF DESCRIPTION OF THE DRAWINGS

The invention will be further demonstrated on its specific embodiments described in conjugation with the accompanying drawings in which.

DESCRIPTION OF THE PREFERRED EMBODIMENTS

Figure 1:
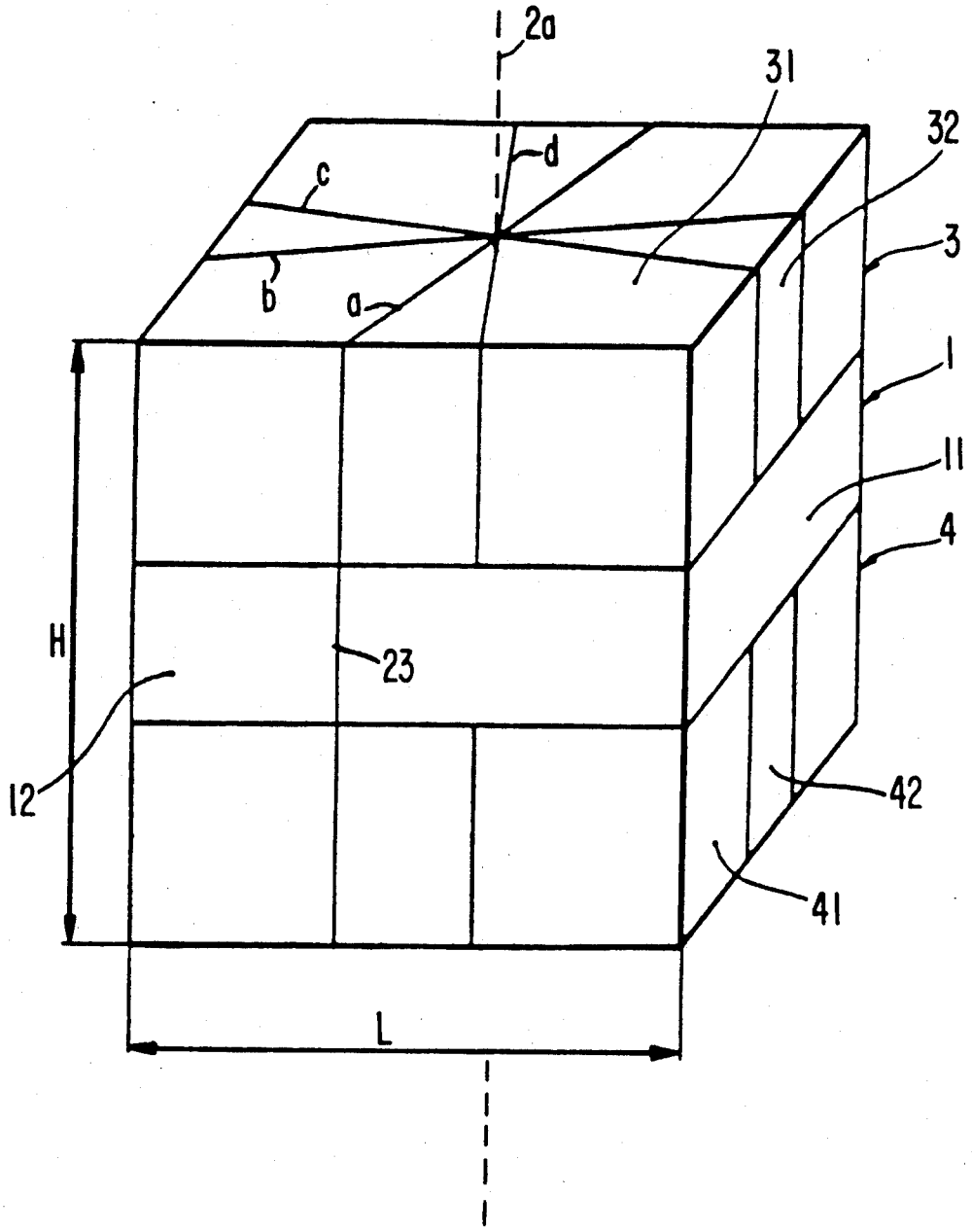
FIG. 1 is a general view of a three-dimensional puzzle in its ground state.

The three-dimensional puzzle illustrated in FIG. 1 includes an internal mechanism not shown on this view, which is associated with three assemblies or structures 1, 3, 4, of exterior segments wherein the exterior segments 11, 12 belong to a middle structure 1, the exterior segments 31, 32, belong to the first peripheral structure 3 and the exterior segments 41, 42, belong to the second peripheral structure 4. The exterior segments 11, 12, of the middle structure 1, are fastened to portions 21, 22 of a cylindrical body 2, of the internal mechanism shown in FIG. 14 and 15. Portions 21, 22 abut one another at parting plane 23. The shape of a regular hexahedral prism constituting the three-dimensional puzzle of the present invention is defined by the ratio of the length L of its base to the height H of the prism, the ratio being expressed by an equation $L/H=\cos 15°$.

Figure 2:
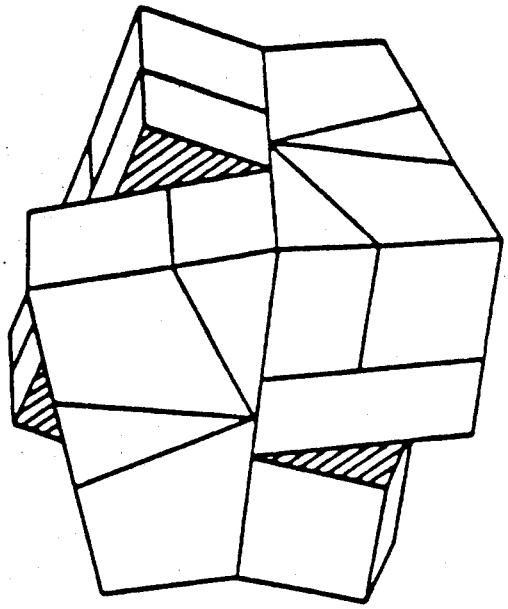
FIGS. 2–7 show several of the possible shape configurations of the three-dimensional puzzle where principal faces of exterior segments belonging to a middle structure are at right angles to each other.
Figure 3:
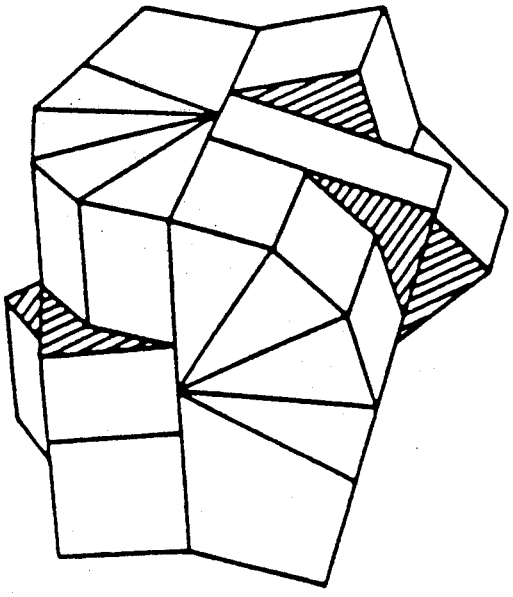
Figure 4:
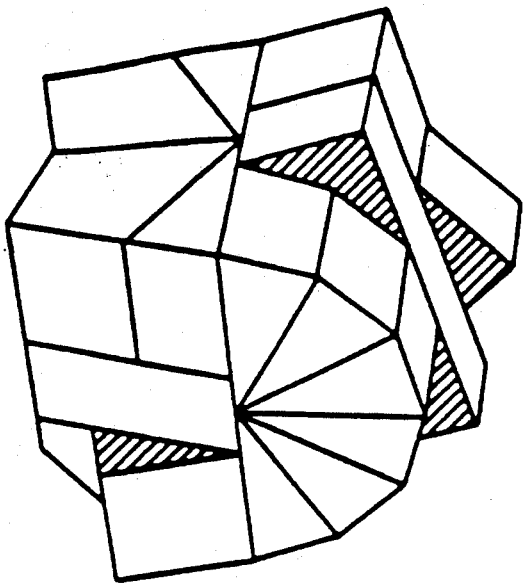
Figure 5:
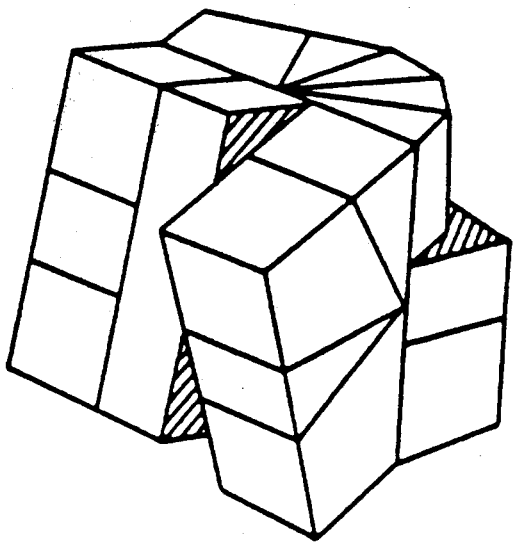
Figure 6:
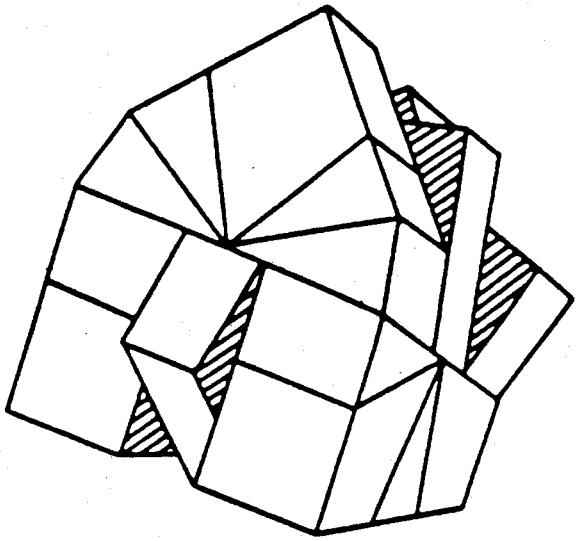
Figure 7:
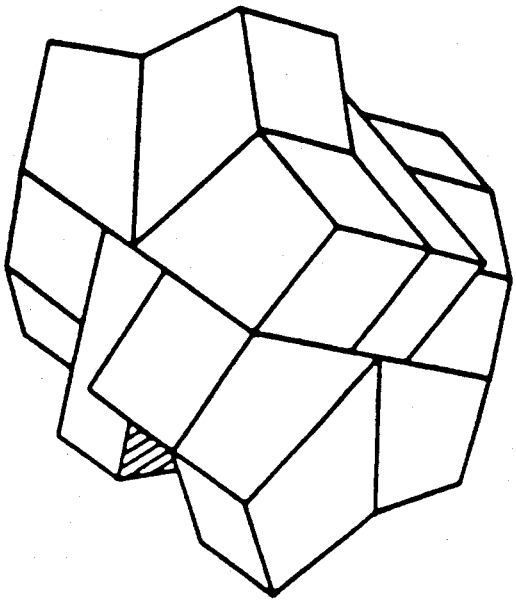

The views in FIGS. 2–7 show some of feasible configurations of the three-dimensional puzzle. The common features of all those embodiments is that the exterior segments 11, 12 of the middle structure 1 stand at right angles to each other such as the case when the portions 21, 22 of the cylindrical body 2 illustrated in FIG. 2 are turned in parting plane 23 about the axis of pivot 51 relative to each other at an angle of 90°.

Figure 8:
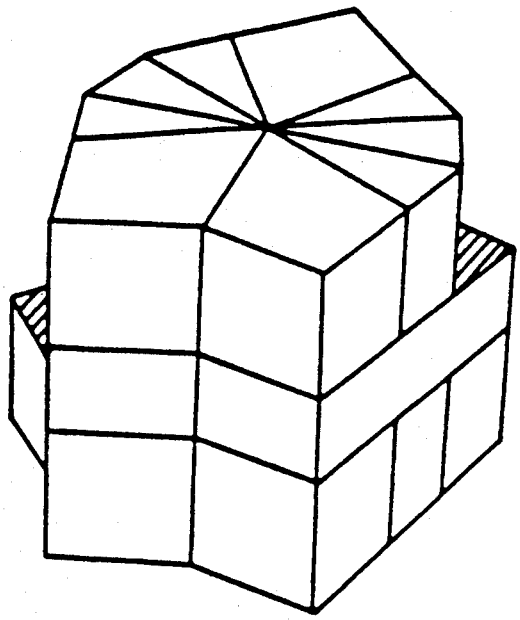
FIGS. 8 and 9 show two of the feasible shape configurations of the puzzle where the corresponding principal faces of the exterior segments belonging to the middle structure are situated in the same plane.
Figure 9:
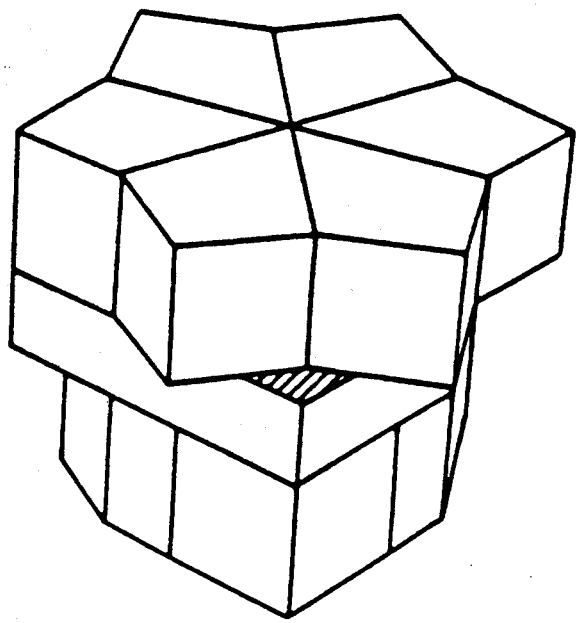

The views in FIGS. 8 and 9 illustrate two feasible configurations of the three-dimensional puzzle where the corresponding principal faces of the exterior segments 11, 12, of the middle structure 1 are situated in the same plane.

Figure 10:
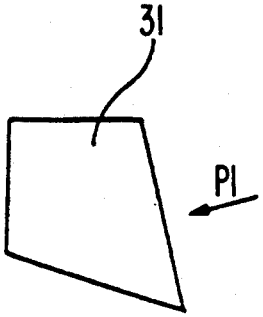
FIG. 10 is a top plan view of a major exterior segment of a peripheral structure.

The plan view in FIG. 10 shows a major exterior segment 31 of the first peripheral structure 3 which is identical in shape with the major segments 41 of the second peripheral structure 4. The shape of the major exterior segment 31 has been created in dividing the first peripheral structure 3 by four vertical planes a, b, c and d which according to FIG. 1 traverse the geometrical center of the prism and stand to the faces of the prism at an angle of 75°. The major exterior segments 41 of the second peripheral structure 4 need not be specifically described because of their identity with the major exterior segments 31.

Figure 11:
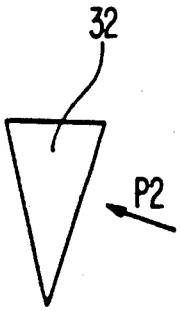
FIG. 11 is a top plan view of a minor exterior segment of the peripheral structure.

The plan view in FIG. 11 illustrates one of the minor exterior segments 32 of the first peripheral structure 3. This segment has been equally created in dividing the first peripheral structure 3 in the same manner as was described in connection with above FIG. 10. The minor exterior segment 32 has a shape of an equilateral triangle with the apex angle of 30°. The minor exterior segments 42 of the second peripheral structure 4 are identical in shape and therefore they need not be particularly described.

Figure 12:
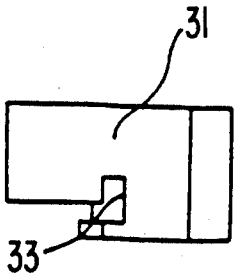
FIG. 12 is a P1 arrow side view of the segment shown in FIG. 10.

The view of FIG. 12 shows the major exterior segment 31 illustrated in FIG. 10 in the direction of the arrow P1. From this view a recess 33 can be seen which is complementary to the radial projection 24 provided on the portions 21, 22 of the cylindrical body 2. The recess 33 enables the rotary support of the major exterior segment 31 with respect to the cylindrical body 2.

Figure 13:
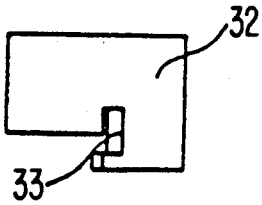
FIG. 13 is a P2 arrow side view of the segment shown in FIG. 11.

The view in FIG. 13 illustrates in the same way as given in connection with FIG. 12 the minor exterior segment 32 shown in FIG. 11 in the direction of the arrow P2. Analogically, the recess 33 can be seen as in FIG. 12.

Figure 14:
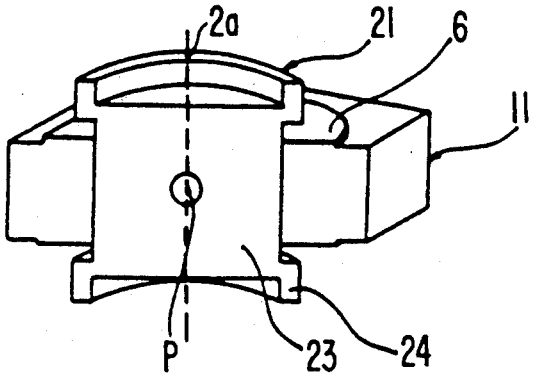
FIG. 14 is an axonometric view of a portion of a cylindrical body of an internal mechanism.
Figure 15:
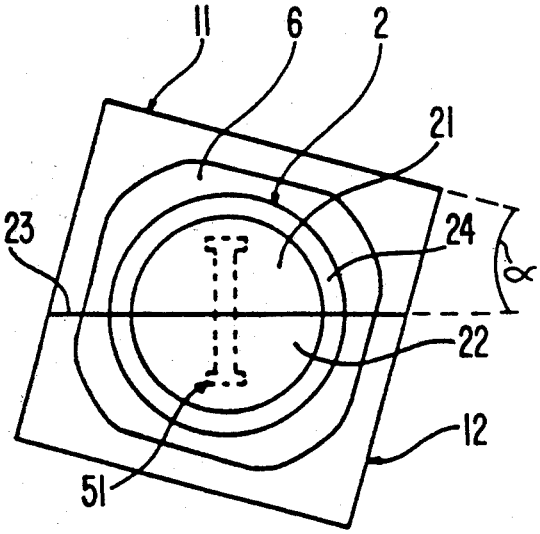
FIG. 15 is a plan view of the mutual connected portions of the cylindrical body with the associated exterior segments of the middle structure in the ground position.
Figure 16:
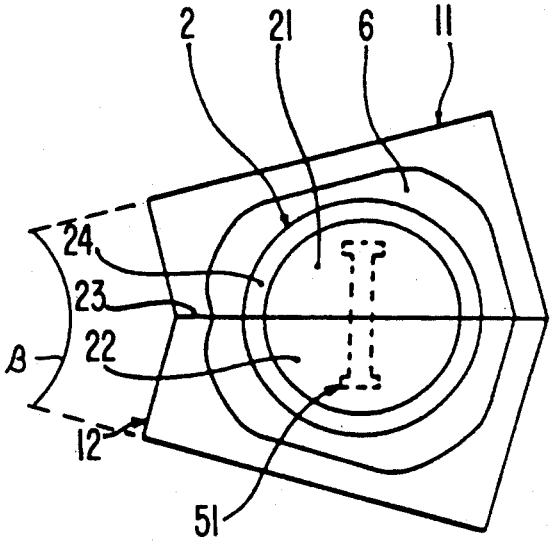
FIG. 16 is a plan view of the connected portions of the cylindrical body with the associated exterior segments of the middle structure turned to each other about a connecting pivot at an angle of 180°.

The first portion 21 of the cylindrical body 2 shown in FIG. 14 is defined by a vertical parting plane 23 dividing the cylindrical body 2 into two identical portions 21, 22. A radial opening 5 for mounting a connecting pivot 51 is provided in the center of the first portion 21 as shown in FIGS. 15 and 16. The pivot 51 may be made of an elastic material. The outside ends of the cylindrical body 2, i.e., its portions 21, 22, are provided with radial projections 24 for securing the exterior segments 31, 32, 41, 42 on the peripheral structures 3, 4 (see FIG. 1 and FIGS. 10–13). The first portion 21 of the cylindrical body 2 is adapted for fixing the exterior segment 11 belonging to the middle structure 1. The segment 11 is on its peripheral structure contacting faces opened towards exterior segments 31, 32, 41, 42 of the peripheral structures 3, 4 (not shown in FIG. 14), provided with a bearing step 6.

The plan view of FIG. 15 illustrates elements described in connection with FIG. 14; moreover, there can be seen the connecting pivot 51 associating herein illustrated portions 21, 22, of the cylindrical body 2. The exterior segments 11, 12 of the middle structure 1 can be mutually situated so that the overall outside arrangement of the exterior segments 11, 12, adjacent each other constitute a quadrant as shown in FIG. 15. It is also apparent in FIG. 15 that the parting plane 23 is not parallel to any of the outside faces of the exterior segments 11, 12. This parting plane includes with the longer opposite face of the exterior segment 11, 12 an angle $\alpha$ of 15°. See FIG. 15. Consequently, the faces of the exterior segments 11, 12 which stand initially parallel in FIG. 15 include in FIG. 16 an angle $\beta$ of 30°.

The plan view of FIG. 16 illustrates elements described in connection with FIG. 14 and FIG. 15. The FIG. 16 is different from FIG. 15 in that the exterior segments 11, 12 of the middle structure 1 are mutually arranged in such a manner that the overall outside form of the adjacent exterior segments 11, 12 constitute an axially symmetrical hexagon created by turning one of the exterior segments 11, 12 together with the respective associated portions 21, 22 shown in FIG. 15 half circle namely 180° with respect to the other segment.

The use and properties of the three-dimensional puzzle of the invention described heretofore with reference to the accompanying drawings are as follows:

The peripheral structures 3, 4, may be turned about the axis 2*a* of the cylindrical body 2 and in determinated positions of the peripheral structures 3, 4, also the portions 21, 22 of the cylindrical body 2 may be turned to each other around the connecting pivot 51, namely, when parting plane 23 is coplanar with one of planes a, b, c and d which divide the peripheral segments 3, 4. The portions 21, 22 are turned together with the exterior segments 11, 12 of the middle structure 1 and with associated ones of exterior segments 31, 32, 41, 42 of the peripheral structures 3, 4, which associated exterior segments are the ones in the respective position in the peripheral structure 3, 4, located on the respective portions 21, 22 of the cylindrical body 2 on either side of parting plane 23. The portions 21, 22 together with the said associated exterior segments 11, 12, 31, 32, 41, 42, may be turned in respect to each other deliberately at an optional angle without jeopardizing the rigidity of the three-dimensional puzzle. Significant positions, with respect to the shape configurations of the three-dimensional puzzle, are those positions where the portions 21, 22, are mutually turned at an angle of 90° or 180°. Some of the feasible shape configurations of the puzzle when the portions 21, 22 are turned in respect to each other at an angle of 90° or 270° are illustrated in FIGS. 2–7.

In FIGS. 1, 8 and 9 there are shown other feasible shape configurations of the three-dimensional puzzle of the invention where the portions 21, 22 of the cylindrical body 2 are turned in respect to each other at angles of 180° and 0°. In the two latter cases the portions 21, 22 are situated in the position shown in FIG. 15 and FIG. 16 respectively. The common feature of these configurations is that the axial outside faces of the peripheral structures 3, 4, are parallel.

The described manner of operation reveals that the puzzle affords the dislocation of the exterior segments 31, 32, 41, 42 from one of the peripheral structure 3, 4, to the other one as a consequence of a 180° relative rotation of body potions 21, 22, and also within the framework of the same structure 3, 4, as a consequence of sliding movement along the respective radial projection 24.

The individual exterior segments 11, 12, 31, 32, 41, 42, are provided with a surface dressing at their outside faces for example with an adhesive foil, varnish etc.

The bearing step 6 minimizes the abrasion of the visible inside faces of the exterior segments 11, 12, 31, 41 during their interaction.

What is claimed is:

1. A three-dimensional puzzle prism comprising a plurality of exterior segments defining vertical and horizontal prism faces, and internal cylindrical means for mounting said exterior segments and for enabling permutation thereof, said exterior segments being grouped into three horizontally layered structures, and said internal cylindrical means including a vertical axis, connecting means for providing rotational movement about said axis of the peripheral ones of said layered structures relative to the middle one of said layered structures and also relative to each other, said internal cylindrical means also having interconnecting means for providing rotational movement in a vertical parting plane passing through said axis and about a radial direction, of those of said exterior segments on one side of said parting plane relative to the exterior segments on the other side of said parting plane, wherein said vertical parting plane forms a first oblique angle with a non-intersecting vertical prism face, wherein said internal cylindrical means includes a cylindrical member disposed along said vertical axis and divided by said vertical parting plane, wherein said interconnecting means includes a radially disposed pivot means passing through the centers of said divided cylindrical member, and wherein said connecting means includes radial projection means disposed on the axial ends of said divided cylindrical member for engaging those of said exterior segments grouped in said peripheral layered structures for sliding rotation about said vertical axis.

2. The puzzle prism as in claim 1, wherein said first oblique angle is substantially 15°.

3. The puzzle prism as in claim 1 wherein the vertical interior surfaces of those of said exterior segments grouped into said peripheral structures are defined by a plurality of vertical defining planes each passing through said axis and forming a second oblique angle with an intersecting prism face.

4. The puzzle prism as in claim 3, wherein said second oblique angle is substantially 75°.

5. The puzzle prism as in claim 3, wherein four vertical defining planes define said peripheral exterior segments.

6. The puzzle prism as in claim 3, wherein said vertical defining planes define major and minor exterior segments, said major exterior segments having a quadrilateral horizontal cross-section, and said minor exterior segments having a triangular horizontal cross-section.

7. The puzzle prism as in claim 1, wherein said prism faces define a regular prism and wherein the ratio of the horizontal base to the vertical height of each of said prism faces is substantially equal to cos 15°.

8. The puzzle prism as in claim 1, wherein at least some of said exterior segments are provided with bearing means disposed between mutually contacting inner surfaces thereof.

9. The puzzle prism as in claim 7, wherein said bearing means includes bearing steps formed on the respective inner surfaces.

10. The puzzle prism as in claim 1, wherein said first oblique angle is substantially 15°, and wherein the vertical interior surfaces of those said exterior segments grouped into said peripheral structures are defined by four vertical planes each passing through said axis and forming a second oblique angle of substantially 75° with an intersecting prism face.

11. The puzzle prism as in claim 1, wherein said peripheral exterior segments include recess means complementing said radial projection means for engagement therewith.

* * * * *

UNITED STATES PATENT AND TRADEMARK OFFICE

CERTIFICATE OF CORRECTION

PATENT NO. : 5,193,809

DATED : March, 16, 1993

INVENTOR(S) : Hrsel et al.

It is certified that error appears in the above-identified patent and that said Letters Patent is hereby corrected as shown below:

On the title page item [76] Inventors:

Third line, change "Praha" to

--Prague--.

Signed and Sealed this

Twenty-first Day of December, 1993

Bruce Lehman

*Attest:*

BRUCE LEHMAN

*Attesting Officer*

*Commissioner of Patents and Trademarks*